US005606940A

United States Patent [19]

Shafer et al.

[11] Patent Number: 5,606,940

[45] Date of Patent: Mar. 4, 1997

[54] ENGINE VALVE SEATING VELOCITY HYDRAULIC SNUBBER

[75] Inventors: Scott F. Shafer, Morton; Thomas S. Carroll, Peoria; Steven F. Meister, Chillicothe; David R. Orr, Pekin; J. Roger Weber, Chillicothe, all of Ill.

[73] Assignee: Caterpillar Inc., Peoria, Ill.

[21] Appl. No.: 576,277

[22] Filed: Dec. 21, 1995

Related U.S. Application Data

[63] Continuation of Ser. No. 107,775, Dec. 31, 1991, abandoned.

[51] Int. Cl.[6] ..... F01L 1/16

[52] U.S. Cl. ..... 123/90.12; 123/90.49; 123/90.66; 251/48; 251/337

[58] Field of Search ..... 123/90.11, 90.12, 123/90.13, 90.14, 90.35, 90.49, 90.65, 90.66; 251/48, 337; 188/297; 267/284; 92/85 B; 91/408, 409

[56] References Cited

U.S. PATENT DOCUMENTS

| | | | |
|---|---|---|---|
| 1,634,198 | 6/1927 | Kinkaid et al. | 123/90.49 |
| 1,675,954 | 7/1928 | Page | 123/90.49 |
| 3,209,737 | 10/1965 | Omotehara et al. | 123/90.12 |
| 4,210,064 | 7/1980 | Beerens | 91/394 |
| 4,776,440 | 10/1988 | Yamada et al. | 188/284 |
| 5,022,358 | 6/1991 | Richeson | 123/90.12 |
| 5,058,538 | 10/1991 | Erickson et al. | 123/90.12 |
| 5,193,495 | 3/1993 | Wood, III | 123/90.12 |
| 5,248,123 | 9/1993 | Richeson et al. | 123/90.12 |

*Primary Examiner*—Weilun Lo
*Attorney, Agent, or Firm*—Joseph W. Keen

[57] ABSTRACT

The present invention is an apparatus 10 for hydraulically slowing a member (12), preferably an engine poppet valve, to an acceptable impact seating velocity as the valve (12) is moved from open to closed. The poppet valve (12) has a stem (16) having a first portion (18) connected through a stepped portion (20) to a second portion (22) having a greater cross-sectional area than the first portion (18). The valve (12) rides within a guide body (28) having an opening (34) in an end wall (32) thereof through which the first portion (18) of the stem (16) extends. A hydraulic fluid space (50) is formed by the guide body (28) and the valve (12). As the valve (12) closes, fluid is forced out of the space (50) through a first fluid exit opening (66). As the valve (12) nears its seat (44), the fluid still in the space (50) is forced out through a second fluid exit opening (68) through which the rate of flow is less than the rate of flow through the first fluid exit opening (66). As the valve (12) continues closing, fluid still in the space (50) is compressed, increasing its hydraulic pressure and creating a resistive force to further movement of the poppet valve (12), thereby slowing it to an acceptable impact velocity.

5 Claims, 3 Drawing Sheets

ENGINE VALVE SEATING VELOCITY HYDRAULIC SNUBBER

This is a continuation application of application Ser. No. 08/107,775, filed Dec. 31, 1991, abandoned.

DESCRIPTION

1. Technical Field

A hydraulic snubber for decelerating a moving member, and more particularly, a hydraulic snubber for decelerating an engine poppet valve during valve closing to an acceptable impact velocity before the valve contacts the valve seat.

2. Background Art

Engine combustion chamber valves are almost universally of a poppet type. A number of means exist for opening such valves including a cam on a rotating cam shaft, hydraulic pressure, electromagnets, and others.

Engine valves are typically spring loaded toward a valve-closed position and opened against the spring bias. Because the valve should open and close very quickly, the spring is typically very stiff and is loaded to a high force under the relatively high force needed to open the valve quickly against the high internal pressures of the combustion chamber. Therefore, when the valve closes, it impacts the valve seat at velocities that can create forces which eventually erode the valve or the valve seat or even fracture or break the valve.

Therefore, it is an object of the present invention to provide a means whereby the valve will be slowed as it nears the valve seat so that the valve seats at an acceptable velocity.

It is an additional object of the present invention to provide a system whereby the valve must close against the force of hydraulic pressure which is relatively slowly dissipated as the valve closes, thereby slowing the engine valve to an acceptable impact velocity.

DISCLOSURE OF THE INVENTION

The present invention is an apparatus for controllably altering the speed of an engine poppet valve during movement of the valve between first (open) and second (closed) locations to an acceptable impact seating velocity.

In a preferred embodiment, the apparatus includes a guide body having side walls and an end wall having an opening therein. The valve is positioned within the guide body. The stem of the valve has a first portion having a first cross-sectional area and a second portion having a second cross-sectional area greater than the first cross-sectional area. The first portion of the stem extends through the opening in the first end of the guide body during a first portion of displacement of the engine valve in the direction from its first location towards its second location. The second portion of the stem extends into the opening during a second portion of displacement of the engine valve in the same direction.

The walls of the guide body and the engine valve within the guide body form a hydraulic fluid space between them. The space has a volume which varies with the position of valve. The volume of the space is greatest when the valve is at its first location and decreases as the valve is moved in the direction from its first location towards its second location. The guide body has a first fluid exit opening(s), which may be the opening in the end wall through which the stem of the valve extends, in communication with the space when the valve is at its first location. The guide body also has a second fluid exit opening(s) in communication with the space when the valve is at its second location. The first and second fluid exit openings are sized relative to each other such that rate of fluid flow through the first fluid exit opening is greater than the rate of flow of fluid through the second fluid exit opening.

A port having a first end in communication with the space at least when the valve is at a location spaced from the second location and a second end in communication with a hydraulic fluid supply communicates hydraulic fluid from the hydraulic fluid supply to the space. When the engine valve is at its second location, the stem of the engine valve covers the first end of the port and prevents fluid communication between the port and the space.

As the valve closes, fluid is forced out of the space through the first fluid exit opening. As the valve nears its seat, the size of the openings in communication with the space decreases to a second fluid exit opening and the fluid still in the space is forced out through the second fluid exit opening. As the valve continues closing, fluid still in the space is compressed, increasing its hydraulic pressure and creating a resistive force to further movement of the poppet valve, thereby slowing it to an acceptable impact velocity.

BEST MODE FOR CARRYING OUT THE INVENTION

Figure 1:
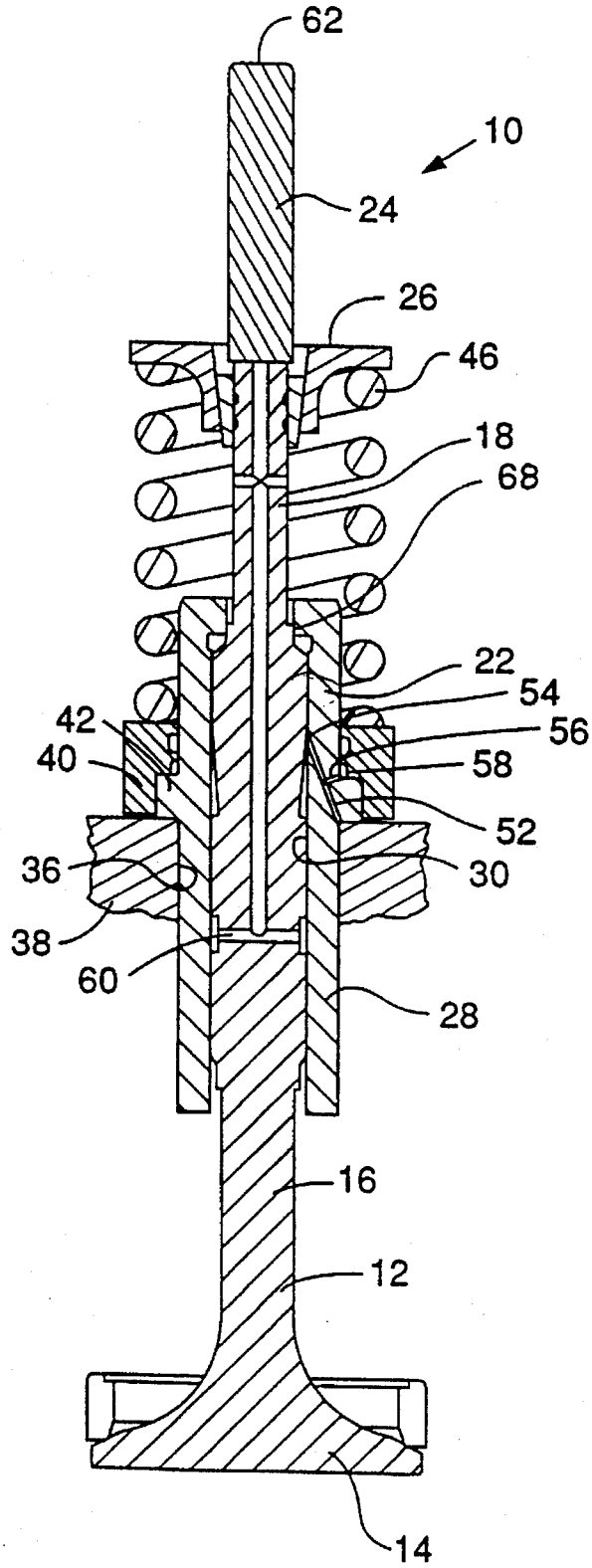
FIG. 1 is an elevational, cross-sectional view of an apparatus of the present invention with the valve at its second location.

Referring now to FIG. 1, a preferred embodiment of an apparatus 10 for controllably altering the speed of a moving member 12, in this case an engine poppet valve is shown. The engine poppet valve 12 includes a head 14 and a stem 16 connected to the head 14. The stem 16 includes a first portion 18 connected through a stepped portion 20 to a second portion 22. The cross-sectional area of the first portion 18 adjacent the stepped portion 20 is less than the cross-sectional area of the second portion 22. A plunger 24 is connected to the stem 16. The valve 12 includes a retainer collar 26 fixedly connected to the stem 16.

The stem 16 rides within a valve guide body 28 having side walls 30 and an end wall 32 having an opening 34 therein through which the first portion 18 of the stem 16 extends. The guide body 28 is seated in a bore 36 in the engine cylinder head 38 and has close diametrical clearance therewith. A clamp 40 is bolted over a flange 42 on the guide body 28 to hold the guide body 28 in place.

Figure 2:
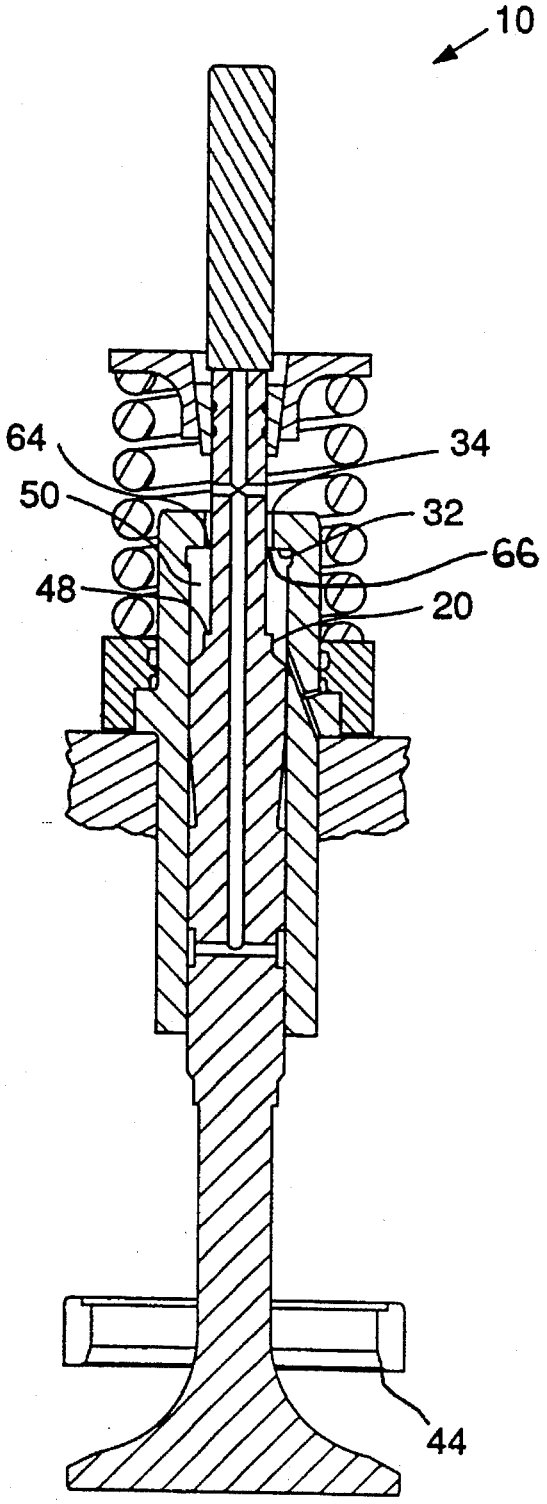
FIG. 2 is an elevational, cross-sectional view of the apparatus shown in FIG. 1 with the valve at its first location.

The engine valve 12 is displaceable between a first location, shown in FIG. 2, at which the engine valve 12 is open and the head 14 of the valve 12 is spaced from the valve seat 44 and a second location, shown in FIG. 1, at which the head 14 of the valve 12 is seated against the valve seat 44. The engine valve 12 is biased to the second location by a preloaded return spring 46 which is retained between the collar 26 and the clamp 40. The valve 12 includes an edge 48 on the stepped portion 20 of the stem 16. The engine valve 12 is guided by the second portion 22 of the stem 16 riding against the side walls 30 of the guide body 28 between which there is close diametrical clearance.

A hydraulic fluid space 50 is formed by the side walls 30 and end wall 32 of the guide body 28 and the first and stepped portions 18,22 of the stem 16. A port 52 extends through the guide body 28 having a first end 54 and a second end 56, the second end 56 being in constant communication with a low pressure hydraulic fluid supply 58, such as engine oil. A hydraulic fluid control vent 60 is formed in the stem 16. Hydraulic fluid which might leak from the space 50 and down the stem 16 is able to be captured in the control vent 60 and vented back up rather than leaking on down into the combustion cylinder.

INDUSTRIAL APPLICABILITY

FIG. 1 shows a hydraulically actuated engine valve 12 at its second (closed) location. Alternatively, the engine valve 12 could be mechanically actuated or opened by some other means. At this location, low pressure fluid of approximately 1000 psi is in communication with the first end 62 of the plunger 24. The low pressure fluid is solely for the purpose of preventing cavitation in the fluid pathway (not shown) that leads to the first end 62 of the plunger 24. When the valve 12 is to be moved towards the first (open) location, shown in FIG. 2, communication of the low pressure fluid with the first end 62 of the plunger 24 is cut off and, instead, high pressure fluid of approximately 21,000 psi is communicated to the first end 62 of the plunger 24.

A preferred means for selectively communicating the high or low pressure fluid through the fluid pathway is by the use of an axially displaceable spool valve (not shown) which, depending upon its axial displacement, communicates either high pressure fluid or low pressure fluid to the fluid pathway.

The force of the high pressure fluid moves the engine valve 12 from its second location towards its first location, loading the return spring 46 as it is further displaced. As the second portion 22 of the stem 16 uncovers the first end 54 of the port 52, hydraulic fluid flows from the low pressure fluid supply 58 through the port 52 and into the space 50. The engine valve 12 continues to open until the valve opening pressure and the return spring 46 are in equilibrium, which is preferably at a valve 12 displacement of about 13 mm, or until the engine valve 12 hits a hard stop. At maximum valve lift, as shown in FIG. 2, the space 50 is at its first, maximum, volume.

When the engine valve 12 is to be closed, communication of the high pressure fluid to the first end 62 of the plunger 24 is cut off and communication of low pressure fluid with the first end 62 of the plunger 24 is opened. Now, the loaded force of the return spring 46 begins to move the engine valve 12 in the direction from its first location towards its second location. As the engine valve 12 is displaced, during a first portion of displacement of the engine valve 12, the fluid in the space 50 is forced out through a first fluid exit opening 66 in the guide body 28, which in the preferred embodiment is that portion of the opening 34 not occupied by the first portion 18 of the stem 16. After some displacement of the engine valve 12, the second portion 22 of the stem 16 covers the first end 54 of the port 52 ending fluid communication of the low pressure fluid supply 58 with the space 50. During a second portion of displacement of the valve 12, which is that portion of displacement over about the last 2 mm of travel before valve seating, the edge 48 of the stepped portion 20 of the stem 16 crosses the edge 64 of the guide body 28. At this point the snubbing action and the slowing of the engine valve 12 to an acceptable impact velocity begins.

Over the last 2 mm of travel, some of the fluid remaining in the space 50 is forced out through a second fluid exit opening 68 in the guide body 28, which in the preferred embodiment, is that portion of the opening not occupied by the second portion 22 of the stem 16. As the valve 12 continues closing, the fluid still in the space 50 is compressed in the ever shrinking volume of the space 50. The compressing of the fluid increases its hydraulic pressure creating a resistive force against the movement of the engine valve 12 and thereby controllably alters its speed to an acceptable impact velocity. Finally, when the head 14 of the engine valve 12 seats, the space 50 is at its least volume.

At this time, the cycle is ready to be repeated which will begin when high pressure fluid is again communicated to the first end 62 of the plunger 24.

Figure 3:
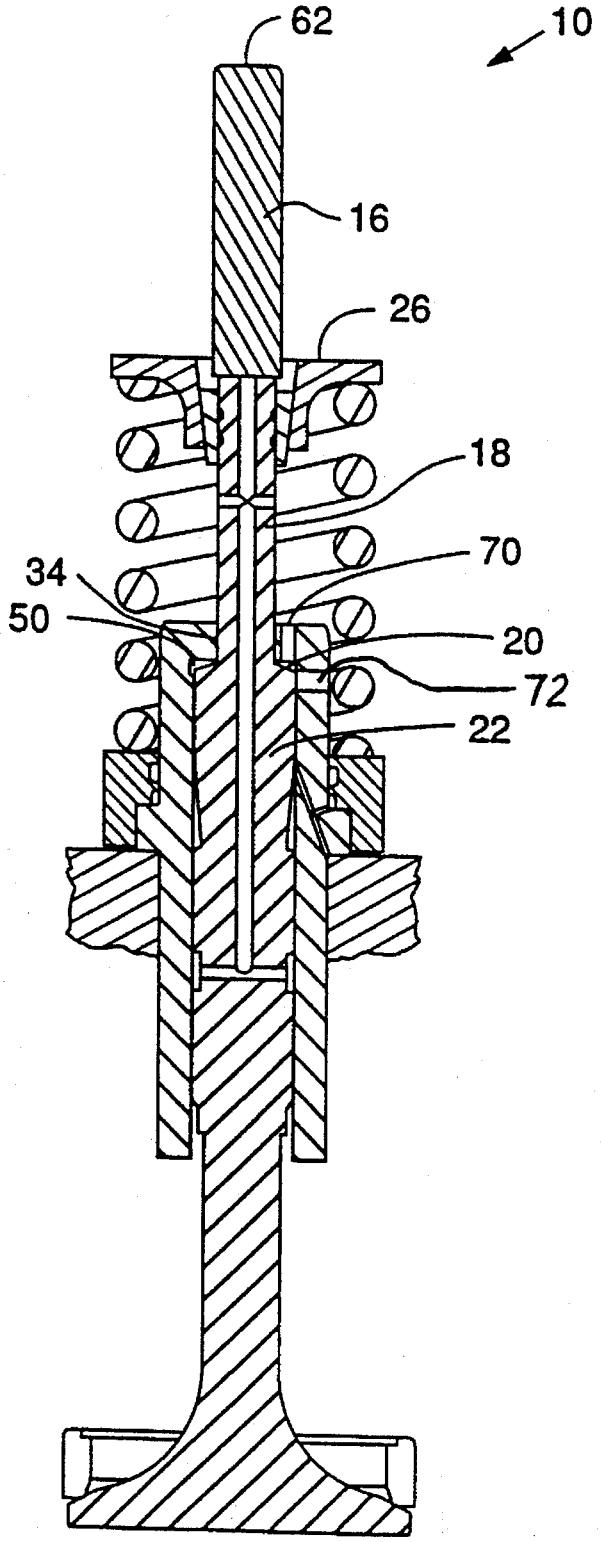
FIG. 3 is an elevational, cross-sectional view of an alternative embodiment of an apparatus of the present invention with the valve at its second location.

In the alternative embodiment shown in FIG. 3, the first portion 18 of the stem 16 and the opening 34 are of such close diametrical clearance that no fluid can pass between them. In this embodiment, two other openings 70,72 exist in the guide body 28. As the valve 12 begins closing, fluid passes out through both openings 70,72, the two openings together forming a first fluid exit opening. When the valve 12 is about 2 mm from closed, it crosses over and cuts-off the side opening 72. Now, the remaining fluid must pass out of the top opening 70 only, which is the second fluid exit opening, and the snubbing action begins.

So, as used in the claims, the term "openings" is intended to include a single opening whose fluid flow area is variable so as to serve as both the first and second fluid exit openings, as described earlier with reference to FIGS. 1 and 2, or multiple openings whose combined fluid flow area is variable, as described earlier with reference to FIG. 3. Also, as used in the claims, the term "first fluid exit opening" and "second fluid exit opening" are used relative to each other to describe openings in the guide body 28 whereby the rate of fluid flow through the first fluid exit opening is greater than the rate of fluid flow through the second fluid exit opening.

Other aspects, objects and advantages of this invention can be obtained from a study of the drawings, the disclosure, and the appended claims.

We claim:

1. An apparatus (10) for controllably altering the speed of an engine poppet valve (12) during movement of the valve (12) between first and second locations, comprising:

a guide body (28) having walls (30);

said valve (12) being positioned within said guide body (28) and being moveable between said first and second locations, said valve (12) having first and second ends;

elements (30,32,12) defining a space (50), said space being disposed between said first and second ends of said valve, said space (50) having a volume which varies with the position of said valve (12), the volume of said space (50) being greatest when said valve (12) is at said first location and decreasing as said valve (12) is moved in the direction from said first location towards said second location;

a first fluid exit opening (66) in communication with said space (50) when said valve (12) is at said first location;

a second fluid exit opening (68) in communication with said space (50) when said valve (12) is at said second location; and a port (52) having a first end (54) in communication with said space (50) at least when said valve (12) is at a location between said first and second locations and is spaced from said second location and a second end (56) in communication with a hydraulic fluid supply (58), said valve (12), when positioned at said second location, obstructing communication between said port (52) and said space (50).

2. The apparatus (10) of claim 1, wherein said valve having a stem (16) and a stepped portion (20) facing in the direction of said second fluid exit opening (68).

3. The apparatus (10) of claim 2, wherein said stem (16) covers said first end (54) of said port (52) and prevents fluid communication between said hydraulic fluid supply (58) and said space (50) when said engine valve (12) is at said second location.

4. The apparatus (10) of claim 2, wherein said guide body (28) has an end wall (32) having an opening (34) therein, said stem (16) has a first portion (18) having a first cross-sectional area and a second portion (22) having a second cross-sectional area greater than said first cross-sectional area, said first portion (18) of said stem (16) extends into said opening (34) in said end wall (32) of said guide body (28) during a first portion of displacement of said engine valve (12) in the direction from said first location towards said second location and said second portion (22) of said stem (16) extends into said opening in said end wall (32) of said guide body (28) during a second portion of displacement of said engine valve (12) in the same direction.

5. The apparatus (10) of claim 1, wherein said valve (12) has a first portion (18) having a first cross-sectional area and a second portion (22) having a second cross-sectional area greater than said first cross-sectional area, said second portion (22) of said valve (12) at least partially covering said first fluid exit opening (66) when said valve (12) is at said second location.

* * * * *